US008261516B2

(12) United States Patent
Laplace

(10) Patent No.: US 8,261,516 B2
(45) Date of Patent: Sep. 11, 2012

(54) APPARATUS AND METHODS FOR INSERTING FOOD PRODUCTS INTO PACKAGES

(75) Inventor: Christian Laplace, Dollard des Ormeaux (CA)

(73) Assignee: Kraft Foods Global Brands LLC, Northfield, IL (US)

( * ) Notice: Subject to any disclaimer, the term of this patent is extended or adjusted under 35 U.S.C. 154(b) by 302 days.

(21) Appl. No.: 12/606,968

(22) Filed: Oct. 27, 2009

(65) Prior Publication Data

US 2010/0101187 A1 Apr. 29, 2010

Related U.S. Application Data

(60) Provisional application No. 61/108,975, filed on Oct. 28, 2008.

(51) Int. Cl.

| | |
|---|---|
| ***B65B 5/10*** | (2006.01) |
| ***B65B 23/16*** | (2006.01) |
| ***B65B 23/12*** | (2006.01) |
| ***B65B 35/20*** | (2006.01) |
| ***B65B 35/02*** | (2006.01) |

(52) U.S. Cl. ..... 53/473; 53/475; 53/246; 53/250; 221/251; 221/268

(58) Field of Classification Search ..... 53/473, 53/475, 244, 246, 249–252, 258; 221/251, 221/268–270; *B65B 5/10, 23/12, 23/16, B65B 35/02, 35/04, 35/20*

See application file for complete search history.

(56) References Cited

U.S. PATENT DOCUMENTS

| | | | | |
|---|---|---|---|---|
| 3,627,102 | A | 12/1971 | Talbot | |
| 3,675,792 | A | 7/1972 | Griner et al. | |
| 3,752,361 | A * | 8/1973 | VanLinder et al. | 221/251 |
| 3,893,282 | A * | 7/1975 | Armbruster et al. | 53/252 |
| 3,927,508 | A | 12/1975 | Campbell, III | |
| 4,013,179 | A * | 3/1977 | Fluck | 221/251 |
| 4,085,563 | A | 4/1978 | Egee et al. | |
| 4,135,345 | A | 1/1979 | Egee et al. | |
| 4,159,761 | A | 7/1979 | Egee et al. | |
| 4,226,073 | A * | 10/1980 | Rose et al. | 53/249 |
| 4,329,920 | A | 5/1982 | Rose et al. | |
| 4,354,589 | A | 10/1982 | Fluck | |
| 4,413,462 | A | 11/1983 | Rose | |
| 4,457,665 | A | 7/1984 | Fluck | |

(Continued)

FOREIGN PATENT DOCUMENTS

CH 103562 2/1924

(Continued)

OTHER PUBLICATIONS

PCT International Search Report dated Jan. 21, 2010 from corresponding PCT Application No. PCT/US2009/062351, 3 pages.

(Continued)

*Primary Examiner* — Stephen F Gerrity

(74) *Attorney, Agent, or Firm* — Fitch, Even, Tabin & Flannery, LLP

(57) ABSTRACT

Apparatus and methods for inserting food products into packages are disclosed, and in particular apparatus and methods for inserting generally thin or planar food products from a stack of such food products into a package. A stacker assembly includes a pusher mechanism for advancing a bottommost food product or products from the stack toward an opening or edge disposed above a package so that the food product or products can fall into the package.

15 Claims, 10 Drawing Sheets

U.S. PATENT DOCUMENTS

| | | | | |
|---|---|---|---|---|
| 4,590,743 | A | 5/1986 | Hardage | |
| 4,712,356 | A | 12/1987 | Hardage et al. | |
| 4,843,799 | A | 7/1989 | Simelunas et al. | |
| 5,095,684 | A | 3/1992 | Walker et al. | |
| 5,235,796 | A | 8/1993 | Campbell, III et al. | |
| 5,752,366 | A * | 5/1998 | Wilfong et al. | 53/246 |
| 6,349,815 | B1 | 2/2002 | Shaffer | |
| 6,543,989 | B1 | 4/2003 | Derenthal et al. | |
| 6,840,369 | B2 | 1/2005 | Derenthal et al. | |

FOREIGN PATENT DOCUMENTS

| | | | | |
|---|---|---|---|---|
| DE | 1051195 | | 2/1959 | |
| DE | 3043991 | | 6/1982 | |
| EP | 0394809 | | 10/1990 | |
| EP | 0900749 | | 6/2004 | |
| GB | 1549183 | | 7/1979 | |
| JP | 03000618 | A * | 1/1991 | 53/246 |
| JP | 06127527 | A * | 5/1994 | |
| JP | 09309511 | A * | 12/1997 | |
| WO | 0160723 | | 8/2001 | |
| WO | WO 2006128443 | A1 * | 12/2006 | |

OTHER PUBLICATIONS

Written Opinion dated Jan. 21, 2010 from the International Searching Authority in corresponding PCT Application No. PCT/US2009/062351, 6 pages.

* cited by examiner

APPARATUS AND METHODS FOR INSERTING FOOD PRODUCTS INTO PACKAGES

CROSS-REFERENCE TO RELATED APPLICATION

This application claims priority to U.S. Patent Application Ser. No. 61/108,975, filed Oct. 28, 2008, the disclosure of which is hereby incorporated by reference in its entirety.

FIELD

This disclosure is directed to an apparatus and method for inserting food products into packages, and in particular to an apparatus and method for inserting food products from a stack of food products into packages.

BACKGROUND

Certain generally thin food products, such as crackers, cookies and the like, can be provided in packages. The packages may be for single-use consumption, where the contents of the package are consumed at one time. The packages may include multiple compartments, such as one for the food product or products and one for a condiment. Such packages may have one thin food product, or may include multiple thin food products. If multiple thin food products are provided in a package, they often times are stacked on top of each other.

The thin food products may be removed from a stack of thin food products prior to their placement into the packages. When a food product is removed from the bottom of the stack of food products, the removed food product typically slides against the next food product in the stack. Due to the weight of the stack, the amount of force required to remove the bottom food product can be increased due to the weight of the remaining food products in the stack pressing down on the bottom food product of the stack. The increased force required to remove or slide the bottom food product from the stack can cause the bottom food product to break, such as due to the impact between a pushing device and the bottom food product. Breakage of the food products can undesirably lead to rejection of the package containing the broken food product. The pieces of the broken food product may not even be properly inserted into a package. If a piece of the broken food product is not inserted in a package, it can lead to stoppage of the packaging assembly line, and thus reduce the efficiency and speed at which the assembly line can package the food products.

In addition, the weight of the stack can cause the food products to be deformed or otherwise marred. In the case of a cracker, the sliding of the bottom food product from the stack of food products in combination with the weight of the stack can cause the upper surface of the food product to break or crumble. Salt or other toppings can also be scrapped from the food products, resulting in less than desirable food products. Crumbled portions and/or toppings, such as salt, of the food products that are removed due to the sliding against the stack of food products and against components of the equipment can accumulate. If too much accumulates, then the crumbles or toppings can interfere with moving parts of the packaging assembly line, a well as lead to an undesirable appearance if some end up in the packaging.

One type of packaging assembly line for placing multiple food products, such as crackers, into individual packages, utilizes multiple conveyor assemblies. Each conveyor assembly has receiving plates for the food products linked in a conveyor belt-like arrangement. Each of the receiving places receives one of the crackers from the stack of crackers. As each receiving plate is tilted as it rounds the conveyor belt-like assembly, the cracker drops into an aligned package. However, this type of packaging assembly line has several disadvantages. For example, if more than one cracker is to be stacked in an individual package, each cracker is dropped from a separate conveyor assembly into the individual package. This can lead to complexities with indexing the packages for each conveyor assembly, increase the time required for filling a package with a stack of crackers, and can lead to compounding of rejects when one of the conveyor assemblies is malfunctioning. The dropping of the cracker from the receiving plate into the package requires a certain minimum drop height, which is a function of the size of the conveyor assembly and the receiving plates. If that drop height is too large, the impact of the cracker in the package can lead to an increased rate of cracker breakage. Yet another disadvantage of such packaging assembly lines is that the cracker ends up in the container in an inverted orientation from that in the stack. If the stack has crackers that are right-side-up, then the package will have such crackers upside-down. This can result in packages that are less visually appealing.

SUMMARY

Apparatus and methods for inserting food products into packages are disclosed, and in particular apparatus and methods for inserting generally thin or planar food products from a stack of such food products into a package. The apparatus and methods can result in increased line speeds, fewer broken food products, fewer marred food products, and more visually appealing packages. As described in greater detail below, the advantages are accomplished at least in part by using one or more of a pusher mechanism for advancing a food product with a variable speed, a pusher that supports a stack of food products for a period of time while advancing a bottom one of the food products, and a brake or lever which at least partially supports the stack of food products so that friction between the bottom food product and the remainder of the stack is reduced as the bottom food product is moved from the stack. Further, the drop height of the food product into the package or tray can be reduced, and the food products can be placed into the package or tray in a preferred orientation.

An apparatus is provided for placing at least one thin food product in a container. The apparatus includes a sleeve sized to hold a plurality of food products in a stack. The sleeve has an inlet at an upper end and an outlet at a lower end. A generally planar plate having an opening is placed beneath the lower end of the sleeve, with the opening being unaligned with the outlet of the lower end of the sleeve. A pusher having at least one contact surface is positioned to selectively contact a lowermost food product of the stack of a plurality of food products and slide the lowermost food product along the plate and over the opening to permit the lowermost food product to drop through the opening and into a container. During this operation, the pusher supports at least a portion of the stack of food products in the sleeve.

In another aspect, a method is provided for depositing one or more thin food products into a tray. The method includes providing a stack of a plurality of the food products and advancing a pusher into contact with a bottom one of the plurality of food products of the stack of food products. The pusher is then used to advance the bottom one of the plurality of food products toward a position above the tray whereby the bottom one of the plurality of food products can fall into the tray. During the step of advancing the bottom one of the plurality of food products toward the position above the tray, the pusher supports the remainder of the stack.

Supporting the remainder of the stack using the pusher can reduce marring and breakage of the food products by not having the stack fall during removal of the bottom food product, but rather when the pusher is removed. The coefficient of friction between the pusher and the stack can be less than between the stack and the bottom food product, thereby permitting a quicker movement of the pusher away from the stack, and hence falling of the stack, than if the stack were to fall as soon as the bottom food product is removed.

An apparatus is also provided for positioning a thin, generally rectangular food product over an opening. The apparatus has a generally planar plate having an opening larger than the thin food product so that the food product can fall through the opening. A pusher is provided with contact surfaces positioned to contact two sides of the food product and slide the food product along the plate and over the opening so that the food product can fall through the opening and into a tray disposed therebeneath. An eccentric drive coupled to the pusher for advancing the pusher into contact with the food product and sliding the food product along the plate and over the opening and for retracting the pusher with a variable speed. The eccentric drive is configured to increase the speed at which the pusher slides the food product along the plate as compared to when the pusher is advanced into contact with the food product.

In yet another aspect, a method is provided for depositing one or more thin food products into a tray. The method includes the step of providing a stack of a plurality of the food products and advancing a pusher into contact with a bottom one of the plurality of food products of the stack of food products at a first speed. Next, the pusher is used to advance the bottom one of the plurality of food products toward a position above the tray at a second speed, the second speed being greater than the first speed, whereby the bottom one of the plurality of food products can fall into the tray.

The use of a dual-speed pusher can advantageously reduce breakage and marring of the food product, while also increasing line speeds. This is because the pusher can quickly be brought into contact the food product at a first, higher speed and with quicker acceleration, and then the acceleration slowed during advancement of the food product to reduced marring and breakage during advancement of the food product. Instead of using the same first, higher accelerating speed to advance the food product after contact, however, the rate of acceleration of the pusher is decreased just prior to contact to move the food product over the opening where it can fall into a tray, which results in an increased line speed as compared to using a constant, lower speed for the pusher. Thus, the pusher is quickly moved toward contact with the food product, thereby increasing line speeds, but then does not continue to accelerate when brought into contact with the food product and during advancement of the food product so as to reduce marring and breakage of the food product.

An apparatus is also provided for reducing the effective weight of food products in a stack of food products. The sleeve may include at least one lever arm positioned between the upper and lower ends. The lever arm is pivotable into the sleeve to at least partially support a portion of food products in the sleeve. This can reduce the effective weight of the stack of food products supported on the pusher by abutting the stack with the arm to at least partially support the weight of the portion of the stack above the arm. This can beneficially result in less marring and breakage of the food products when contacted by the pusher. This is because there is less sliding resistance between the food product being moved by the pusher and the food products disposed above that food product, which are initially supported by the bottom food product, then a combination of the bottom food product and the pusher, and finally by just the pusher when the bottom food product is positioned over the opening. Less sliding resistance can result in less potential for marring or breakage of the food products, as well as can enable increased line speeds.

DETAILED DESCRIPTION OF THE DRAWINGS

Apparatus and methods for inserting food products into packages, and in particular to an apparatus and method for inserting food products from a stack of food products into packages, is described herein and has various aspects depicted in the exemplified embodiment illustrated FIGS. 1-9. It is configured to achieve the advantages of reduced breakage and marring of the food products, maintain a preferred orientation of the food products being inserted into the packages, and reduce generation of crumbs from the food products, while permitting high speed removal of the food products from the stack and insertion into the packages. The food products may be any type of food product that can be stacked and removed from a stack using automated equipment, but is described herein with reference to thin food products, and in particular with reference to crackers.

Figure 1:
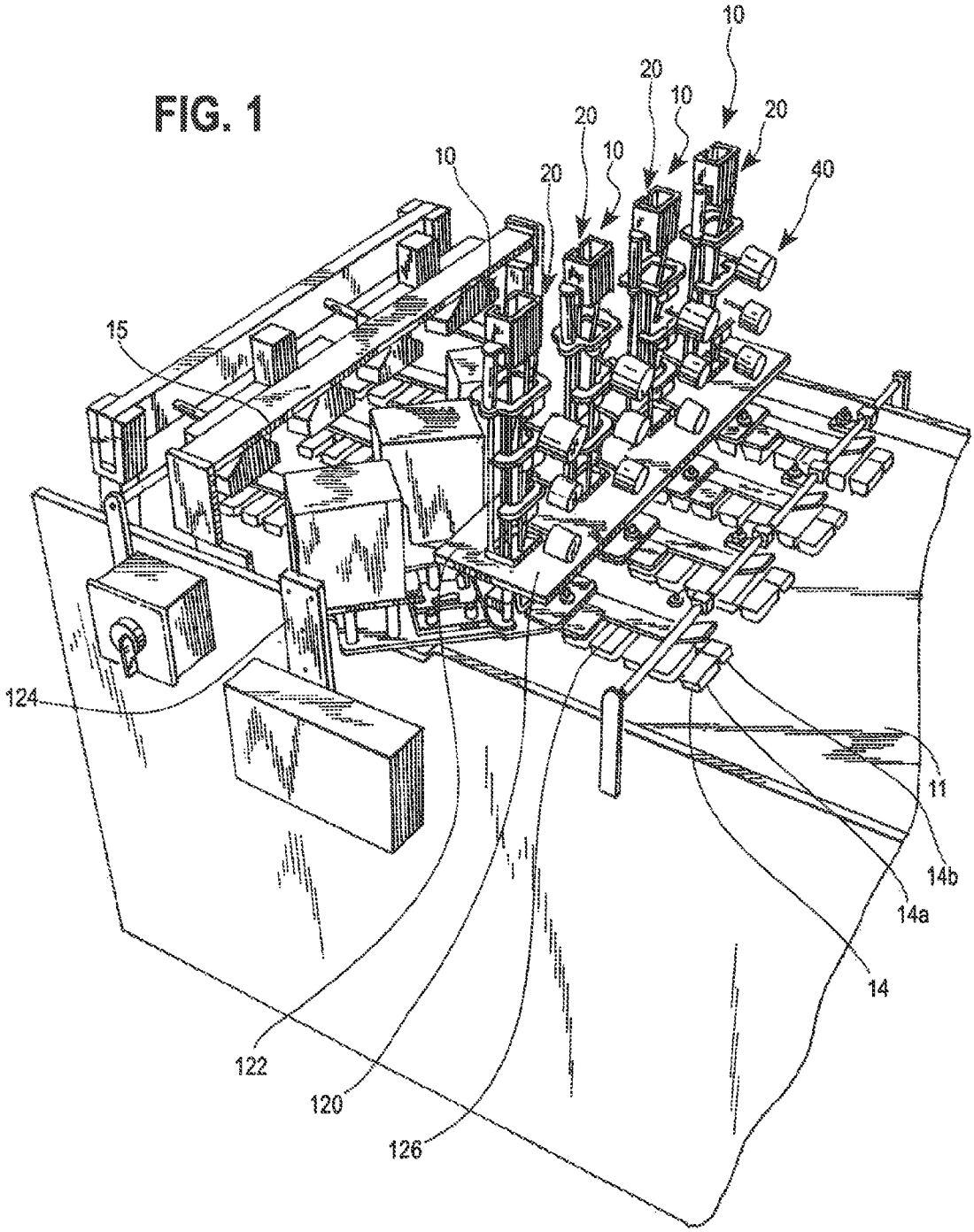
FIG. 1 is a perspective view of a an apparatus for inserting stacks of crackers into trays, and showing four cracker stacking assemblies for inserting stacks of crackers into trays disposed beneath each of the stacking assemblies.

The food products are fed to a food product stacker assembly 10. The food product stacker assembly 10 is positioned above a conveyor 11 or the like which is advancing packages in the form of trays 14 to positions beneath the stacker assembly 10, as illustrated in FIG. 1. Multiple stacker assemblies 10 may be utilized for a single conveyor 11 which is conveying a like number of trays 14 in parallel. The stacker assemblies 10 each accumulate a stack of crackers 12 or other food products from a feed tube or other such delivery device and then remove a bottommost one or group of crackers 12 from the stack and advance along a plate to over an opening or space where they can drop into a tray 14 disposed beneath the opening or space. The stacker assembly 10 generally includes a feed chute 20 for accumulating a stack of crackers mounted to and disposed above a pusher assembly 70. The pusher assembly 70 removes the crackers 12 from the bottom of the stack in the feed chute 20 by using a pusher 82 to slide the cracker 12 from the bottom of the stack and toward the opening or space, where it can fall into the tray 14.

The tray 14 can have multiple compartments, the other compartments of which can be filled either upstream or downstream of the stacker assembly 10. After filling, the trays 14 can be sealed, such as by application of a flexible film over the top of a thermoformed or otherwise formed generally rigid tray. A vacuum 15 can also be used downstream of the stacker assembly 10 for removing excess debris, such as crumbs, prior to or after sealing. Further, major and minor trays 120 and 122 can be positioned adjacent the stacker assembly 10 for collecting debris, such as crumbs, for periodic disposal. In the illustrated example, the tray 14 has two compartments, a cracker compartment 14*a* and an adjacent compartment 14*b*, which can hold, for example, a dippable or spreadable food product, such as chocolate, cheese or peanut butter. A shield 126 may be placed over the adjacent compartment 14*b* during inserting of the crackers 12 into the cracker compartment 14*a* of the tray 14. In the illustrated example, a stack of three to six crackers 12 are inserted into the tray 14 one at a time, although more crackers 12 could be inserted depending upon the depth of the compartment 14*a*. Further, more than one cracker 12 at a time could be inserted into the tray 14.

The feed chute 20 has an open upper end and an open lower end and is configured to form the crackers 12 into a stack, which in the illustrated example is essentially a vertical stack. In addition to arranging the crackers 12 into a stack, the feed chute 20 has the additional functions of directing the crackers 12 toward a position where the bottommost cracker 12 or group of crackers are sequentially removed from the stack by the pusher assembly 80 and advanced to an opening 100 in a support plate 76 whereby the cracker 12 or group of crackers can fall into a tray 14 or other package disposed beneath the opening 100, as will be described in greater detail below. The feed chute 20 in the illustrated example is also configured for reducing contact with the crackers 12 of the stack, which can beneficially result in less breakage and marring of the crackers 12. Further, one or more brakes 40 can be provided on the feed chute 20 in order to reduce the effective weight of the stack, as will also be described in greater detail below.

Figure 2:
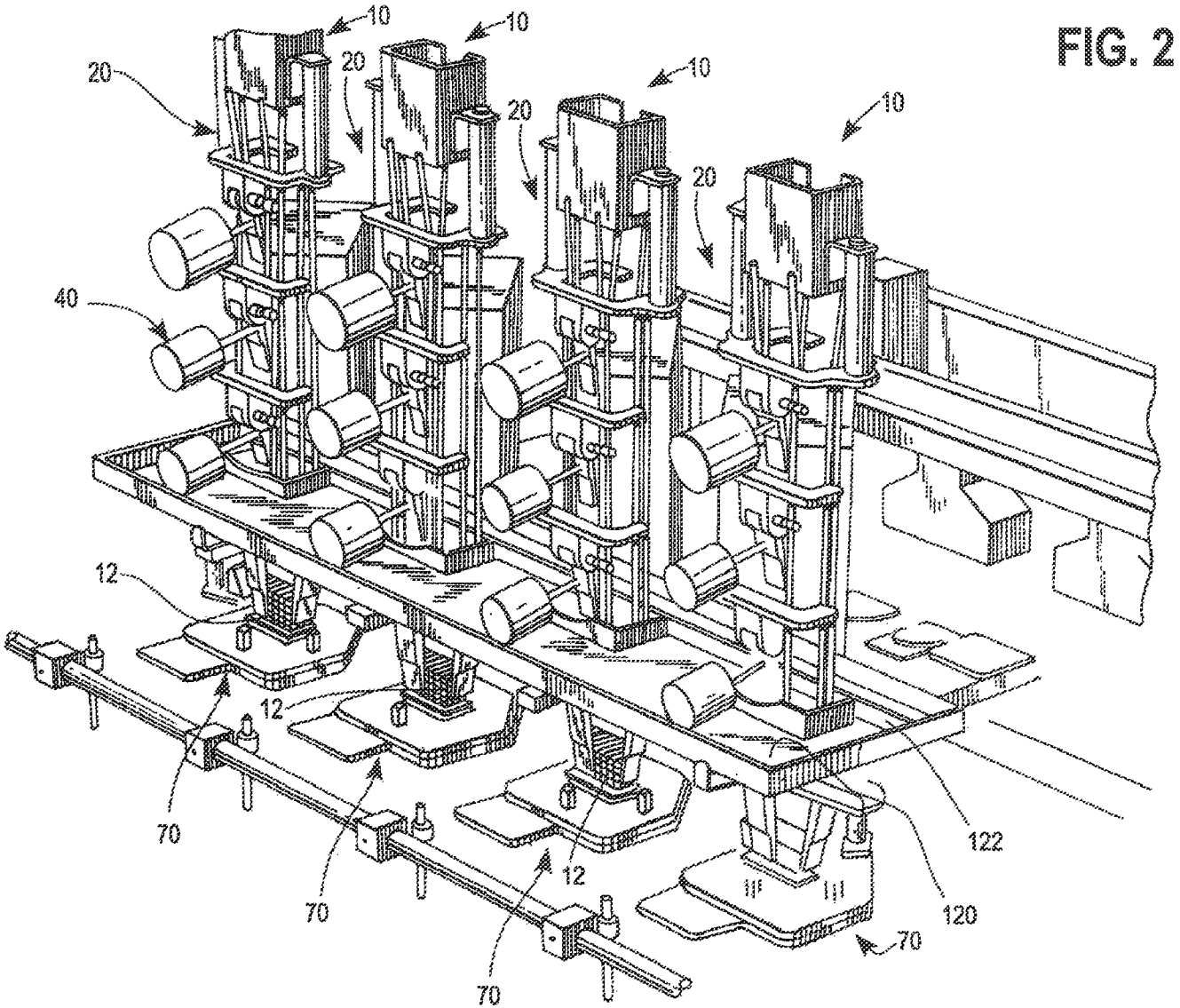
FIG. 2 is a perspective view of the four cracker stacking assemblies of FIG. 1.
Figure 3:
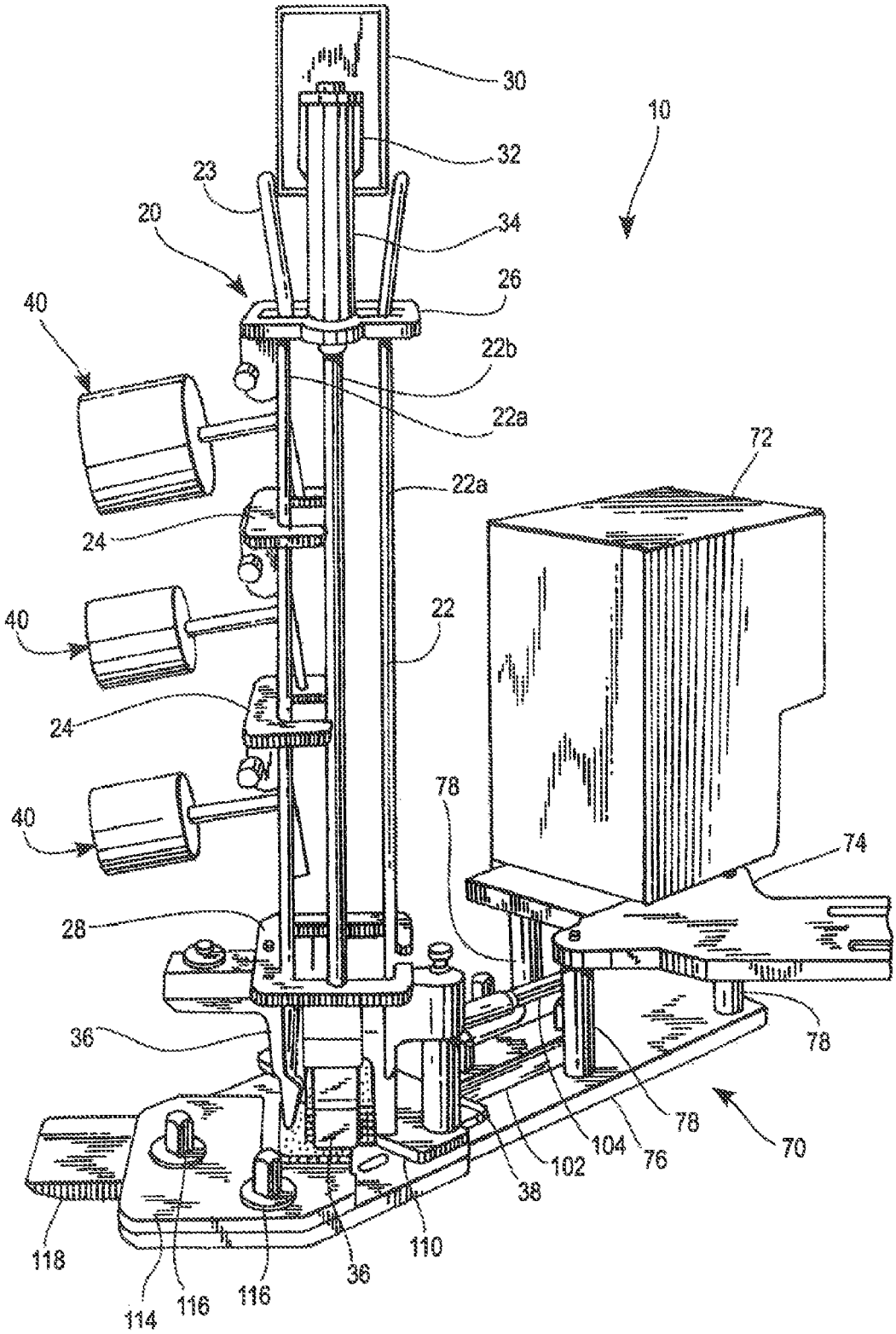
FIG. 3 is a perspective view of one of the four cracker stacking assemblies of FIG. 1, showing a feed chute positioned to feed crackers to a pusher assembly for depositing the crackers in stacks in a tray.

The feed chute 20 includes a plurality of guide rods 22 for confining the stack of crackers 12. For the generally rectangular crackers 12 depicted in the drawings, at least one guide rod 22 is positioned to confine each side of the crackers 12 in the stack. As illustrated in FIGS. 2 and 3, two guide rods 22*a* are positioned adjacent each of the longitudinal sides, i.e., the longer sides, of the crackers 12 in the stack, and one guide rod 22*b* is positioned adjacent each of the transverse sides, i.e., the shorter sides, of the crackers 12. The guide rods 22 are held together using multiple supports, including an upper guide rod support 26, a lower guide rod support 28, as well as one or more intermediate guide rod supports 24. The use of guide rods 22, as opposed to a completely enclosed sleeve, advantageously can minimize contact between the guide rods 22 and the crackers 12. This has several beneficial results, including less friction and hence easier movement of the stack in the guide rods 22, simplified construction and access to the stack to identify and remove any jammed crackers 12 or other misaligned crackers, as well as less contact and rubbing, and hence less potential for crumbs to be generated.

Disposed adjacent the upper end of the feed chute 20 is an infeed chute 30. The infeed chute 30 is configured to permit operative connection to a feeder, such as a vacuum tube or pressurized tube, for feeding crackers 12 to the feed chute 20. Preferably, though not necessarily, the crackers 12 are each positioned into a predetermined orientation, such as with a top of the cracker 12 facing upwardly and/or all in the same direction, prior to being fed into the feed chute 20 via the infeed chute 30. The infeed chute 30 can be a generally rectangular sleeve, having an open top and bottom. The infeed chute 30 can be supported relative to the guide rods 22 via a pair of supporting columns 34 each joined to an associated bracket 32 on opposite sides of the infeed chute 30. More particularly, the supporting columns 34 are attached to the upper guide rod support 26 and extend upwardly therefrom, and an opposite ends from the guide rod support 26 are attached via intermediary brackets 32 to side walls of the infeed chute 30. The guide rods 22 may have outwardly-bent upper ends 23, as shown in FIGS. 2 and 3, that abut against the side walls of the infeed chute 30. The outwardly-bent upper ends 23 of the guide rods 22 function to ensure that there is a smooth, generally unimpeded flow of crackers 12 through the infeed chute 30 and into the stack of crackers 12 by eliminating exposed, abrupt structures upon which the crackers 12 may catch downstream of the infeed chute 30.

Figure 6:
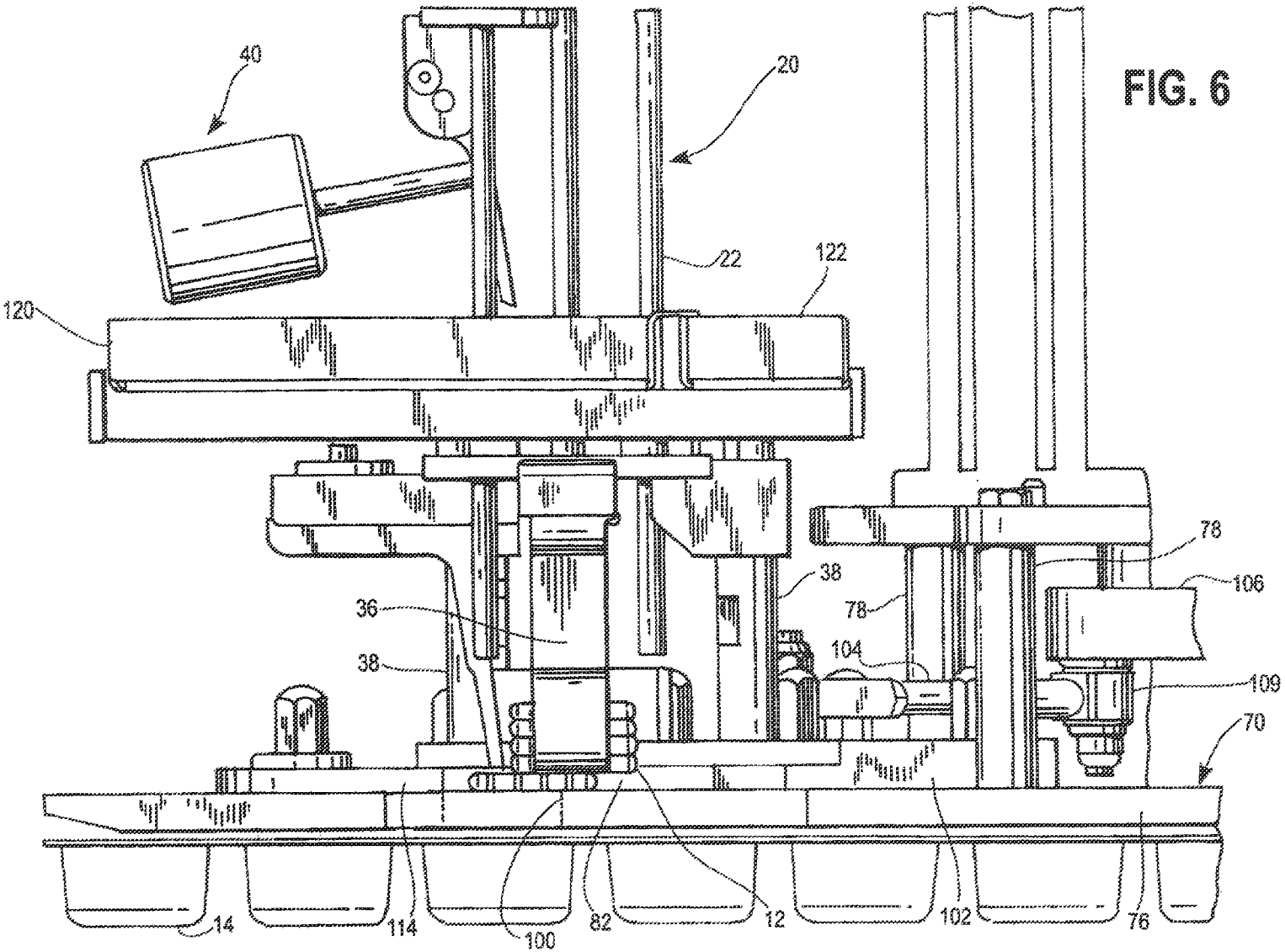
FIG. 6 is a partial side elevation view of the cracker stacking assembly of FIG. 3, showing a portion of the feed chute, the pusher assembly and a series of trays disposed beneath the pusher assembly.

The lower ends of the guide rods 22 do not extend to the end of the feed chute 20. Instead, a plurality of lower fingers 36 depend from the lower guide rod support 28, as illustrated in FIGS. 2, 3 and 6, in order to direct the stack of crackers 12 to the position partially resting on the plate 76, illustrated in FIG. 7*a*. The fingers 36 may be positioned on all four sides of the feed chute 20, in the example where the food product is a generally rectangular cracker 12 or the like, although other configurations of the fingers 36, and, indeed, the guide rods 22 and infeed chute 30 can be made depending upon the shape or footprint of the food product. The feed chute 20 can be supported relative to the plate 76 using a plurality of posts 38 that extend between the plate 76 and the lower guide rod support 28 and/or extensions of the fingers 36.

The feed chute 20, including the lower fingers 36, position the crackers 12 to rest on the plate with a significant portion already positioned over the opening 100, but yet two of the four sides rest on the plate 76. This positioning enables the cracker 12 to transit less as it is moved toward the opening 100 than if the cracker 12 were entirely spaced from the opening 100. Less transit can beneficially correspond to less marring and breakage of crackers 12, as well as a shorter movement required by the pusher 82 of the pusher assembly 80 to move the bottommost cracker 12 or group of crackers into position above the opening 100, whereby the crackers 12 can fall through the opening 100 in into a tray 14 disposed beneath the opening 100 in the plate 76. A shorter movement require by the pusher 82 can advantageously result in increased speeds for the filling operation because the pusher 82, and thus the cracker 12, has less of a distance to travel to be positioned completely over the opening 100.

The pusher assembly 70 includes a pusher 80 for contacting the bottommost cracker 12 in the stack of crackers. The pusher 80 slides on a plate 76 toward and away from an opening 100 in the plate 76, illustrated in FIGS. 4 and 5. As will be described in greater detail below, the pusher 80 is limited to a reciprocal movement by a pair of opposing guides 102, and the pusher 80 is moved using a motor 72 having a shaft with an eccentric connection relative to the pusher 80.

Figure 7B:
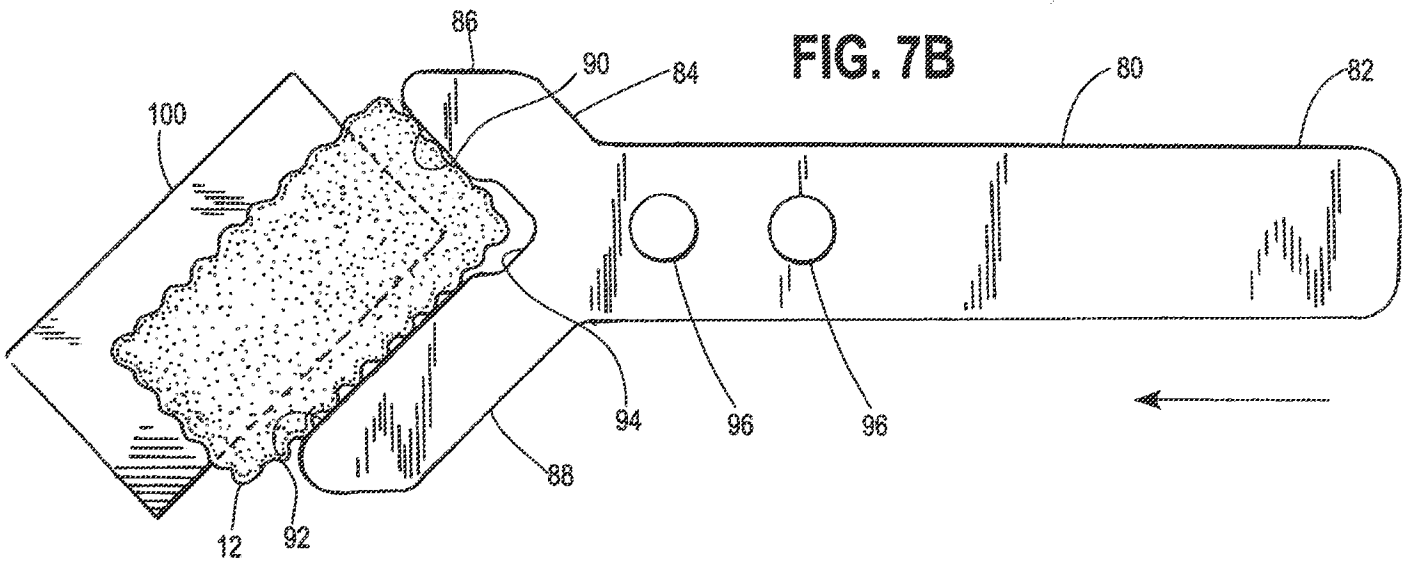
FIG. 7*b* is a diagrammatic top plan view similar to FIG. 7*a*, but showing the pusher contacting the cracker.
Figure 7A:
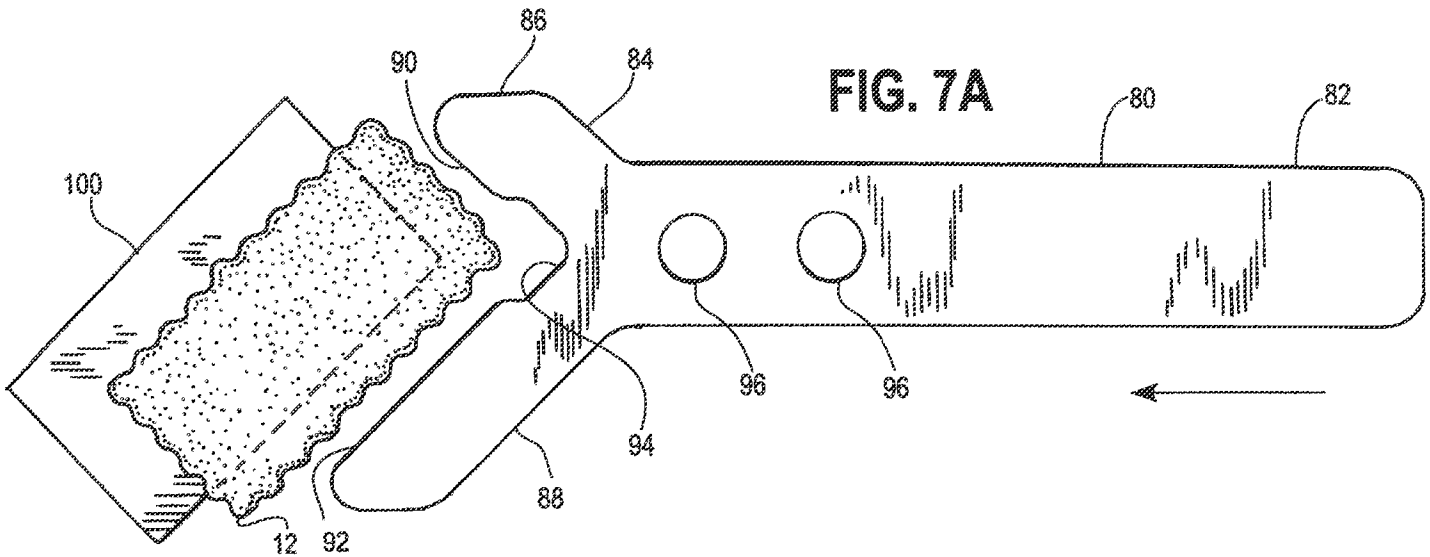
FIG. 7*a* is a diagrammatic top plan view of the pusher of FIG. 4 for moving a cracker toward the opening in the plate, showing the pusher prior to contact with the cracker.
Figure 7D:
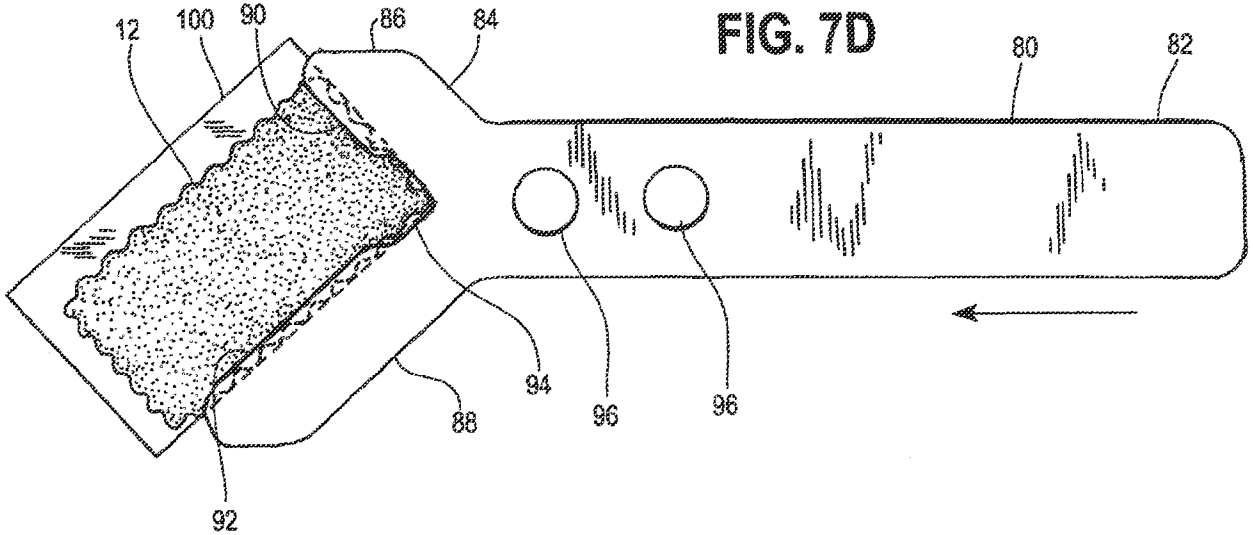
FIG. 7*d* is a diagrammatic top plan view similar to FIG. 7*a*, but showing the pusher moving partially over the opening after the cracker has fallen through the opening toward a tray disposed therebeneath.
Figure 7C:
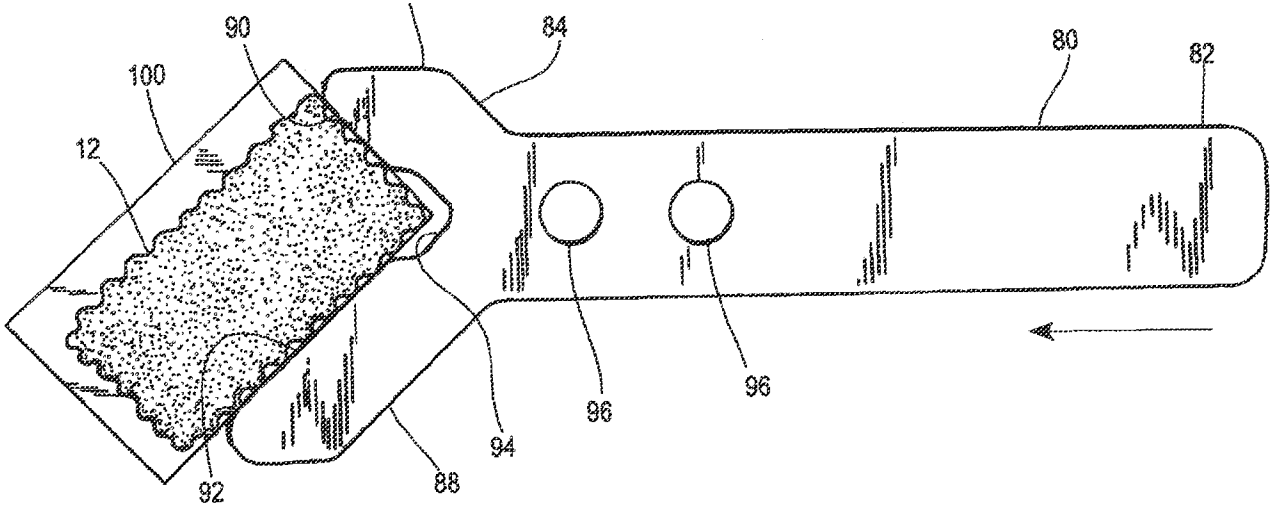
FIG. 7*c* is a diagrammatic top plan view similar to FIG. 7*a*, but showing the pusher positioning the cracker over the opening so that the cracker can fall through the opening an into a tray disposed therebeneath.

The movement of the pusher 80 has two distinct directions in its cycle. The first direction is toward the opening 100 and the second, opposite direction is away from the opening 100. When the pusher 80 initially begins moving toward the opening 100, it is spaced from contact with the bottommost cracker 12, as illustrated in FIG. 7*a*. Immediately prior and after the pusher 80 makes contact with the bottommost cracker 12, the latter as shown in FIG. 7*b*, the acceleration of the pusher 80 toward the opening 100 decreases. This decreased acceleration continues as the pusher 80 moves the cracker 12 toward a position over the opening 100, as illustrated in FIG. 7*c*. After the cracker 12 falls through the opening 100, the pusher 80 continues to its position of maximum advancement, which is slightly over the opening 100 as illustrated in FIG. 7*d*. This ensures that the cracker 12 will have fallen through the opening 100. From its position of maximum advancement, the pusher 80 then retracts away from the opening. From the position where the cracker 12 has fallen through the opening, illustrated in FIG. 7*c*, to its position where the pusher 80 is slightly over the opening 100, as illustrated in FIG. 7*d*, and continuing through its initial retraction, the pusher 100 accelerates quickly, then decelerates again and reverses at the point of maximum retraction, where the process begins again.

Figure 9:
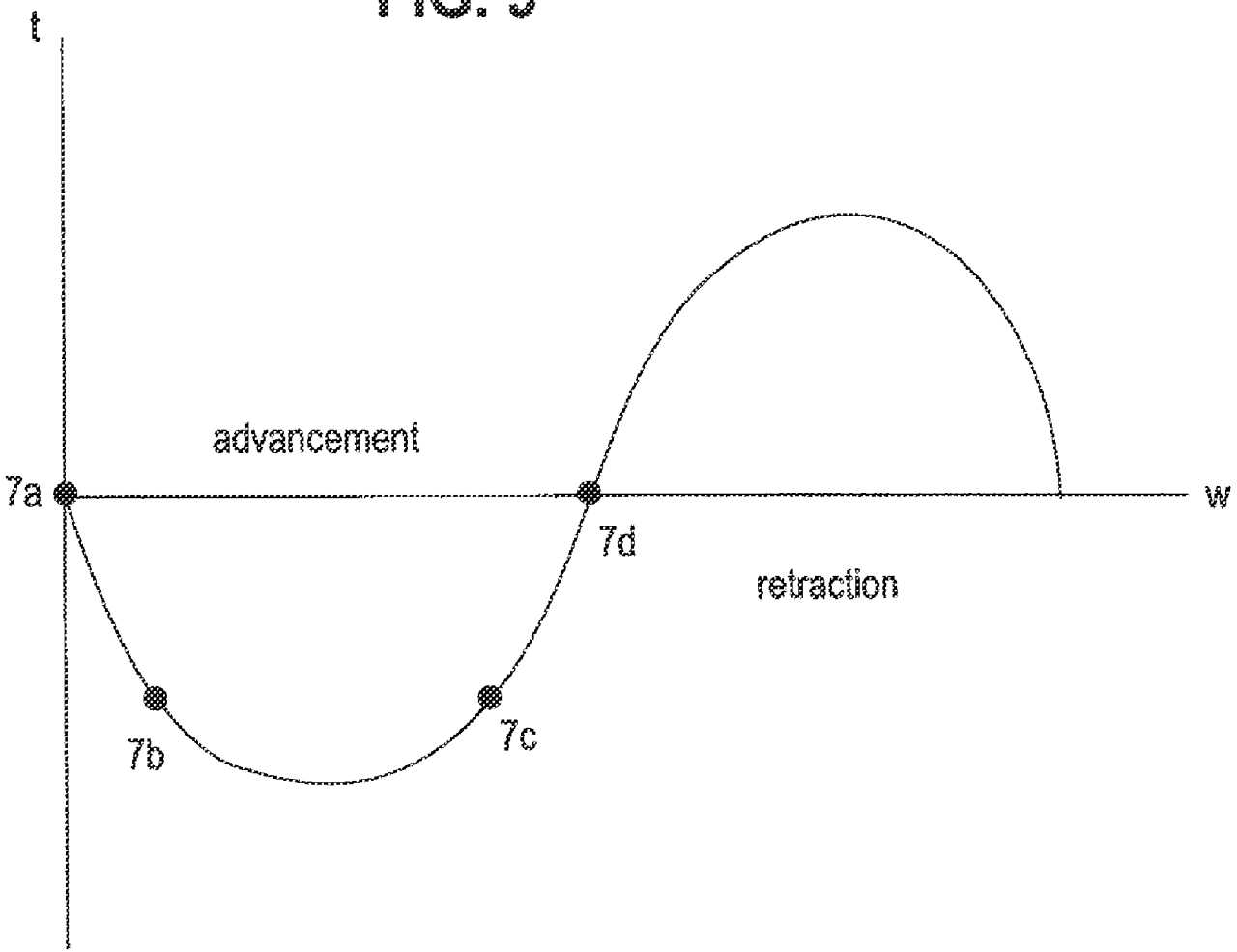
FIG. 9 is a representative comparison of the angular displacement of a shaft of a motor which controls movement of the pusher of the pusher assembly over time during both advancement of the cracker toward the opening and retraction of the pusher after the cracker has fallen through the opening, and indicating the corresponding positions of FIGS. 7*a*, 7*b*, 7*c* and 7*d*.

A representative comparison of the angular rotation of the shaft (not shown) of the motor 72 over time, and showing both the advancement and retraction stages of the pusher 80, is depicted in FIG. 9. Further, the positions of the pusher 80 corresponding to FIGS. 7*a*, 7*b*, 7*c* and 7*d* are indicated. As can be seen from FIG. 9, the pusher 80 movies very quickly from its point of maximum retraction (7*a*) to just before it contacts the bottommost cracker 12, at which point it is speed continues to increase, but yet at a reduced degree of acceleration. This has the benefit of minimizing the impact between the pusher 80 and the cracker 12, while still moving the cracker 12 at a high speed after contact to the position where the cracker 12 can fall through the opening 100 (7*c*). The pusher 80 then speeds up as it moves from the position where the cracker 12 can fall through the opening 100 (7*c*) to the position where the cracker 12 has fallen through the opening 100 and the pusher 80 is positioned slightly over the opening 100 (7*d*), the point of maximum advancement. After that, the pusher 80 then begins its retraction until it returns to the point of maximum retraction (7*a*). During the advancement of the pusher 80, the timing of its periods of maximum acceleration (between 7*a* and 7*b*) and maximum deceleration (between 7*c* and 7*d*) preferably, though not necessarily, occur when the pusher 80 is not in contact with the cracker 12. This can result in a reduced impact between the pusher 80 and the cracker 12, as well as a comparatively constant (though not exactly constant) speed during advancement and contact with the cracker 12, which also achieving a high speed. This can advantageously reduce marring and breakage of the cracker 12, while permitting high speeds of operation.

Turning now to more details regarding the construction of the pusher assembly 70, illustrated in FIGS. 7*a*, 7*b*, 7*c* and 7*d*, the pusher 80 has an elongate shank 82 with a head 84 at an end positioned for contact with the cracker 12. Weight-reducing apertures 96 can optionally be formed in the shank 82. The head 84 has a pair of wings 86 and 88 that each have a pad 90 and 92, respectively. The pads 90 and 92 are orientated approximately perpendicularly relative to each other, which in this example corresponds with the angle of intersecting sides of the cracker 12. The pads 90 and 92 each extend outwardly from the respective wings 86 and 88, but have a gap 94 therebetween. The purpose of the gap 94 is so that if the angle of intersection between the cracker 12 sides does not precisely correspond with the angle of intersection between the pads 90 and 92, the sides of the cracker 12 can still be contacted by the pads 90 and 92, as opposed to the corner of the cracker 12. In such a circumstance of an irregular cracker 12, the corner of the cracker 12 can fit into the gap 94 so that the pads 90 and 92 are not pushing or contacting the corner. Minimizing contact with the corner of the cracker 12 can advantageously result in reduced breakage and marring of the cracker because the contact force is spread out over a greater surface area of the cracker 12, as opposing to being concentrated in the corner of the cracker 12.

Figure 4:
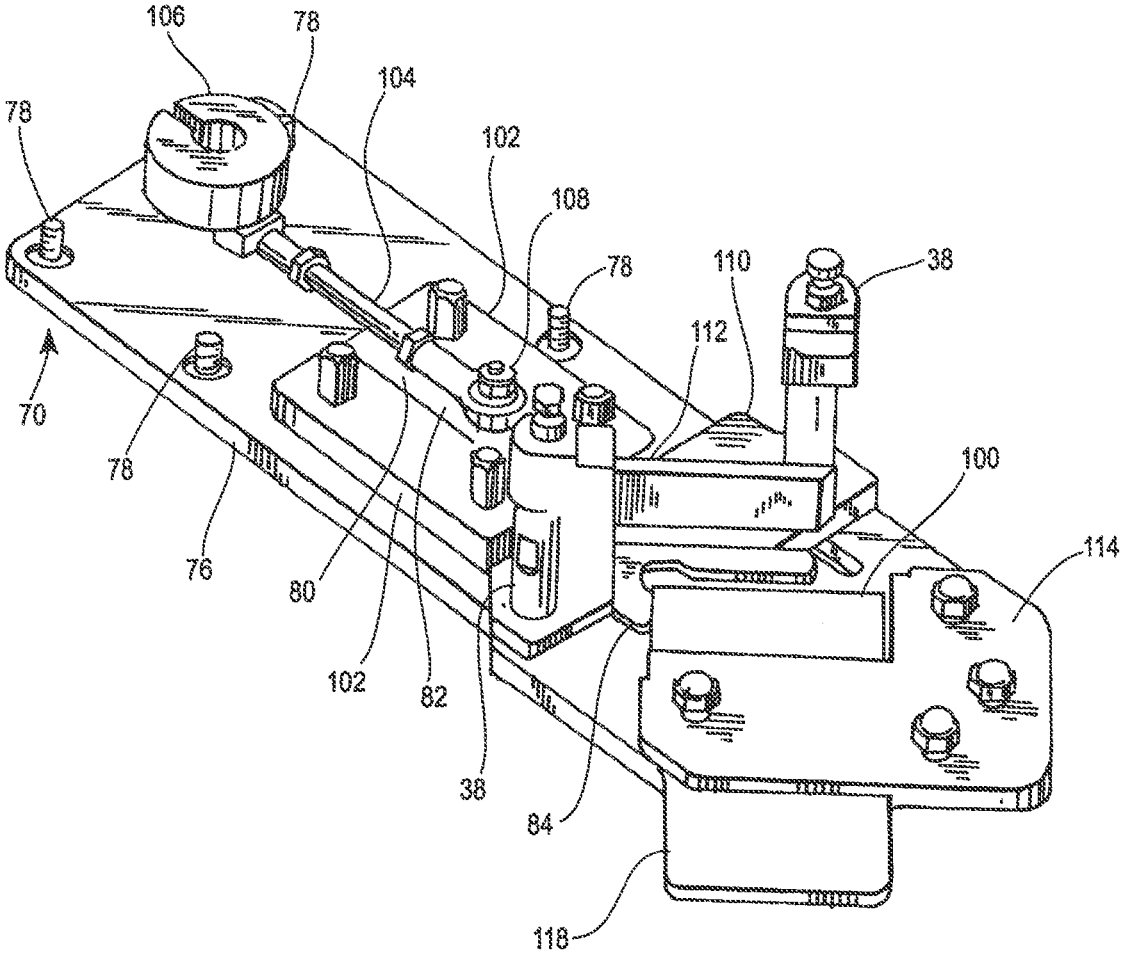
FIG. 4 is a perspective view of the pusher assembly of FIG. 3, showing a reciprocating pusher for moving a cracker toward an opening in a plate, through which the cracker can fall into a tray positioned therebeneath.
Figure 5:
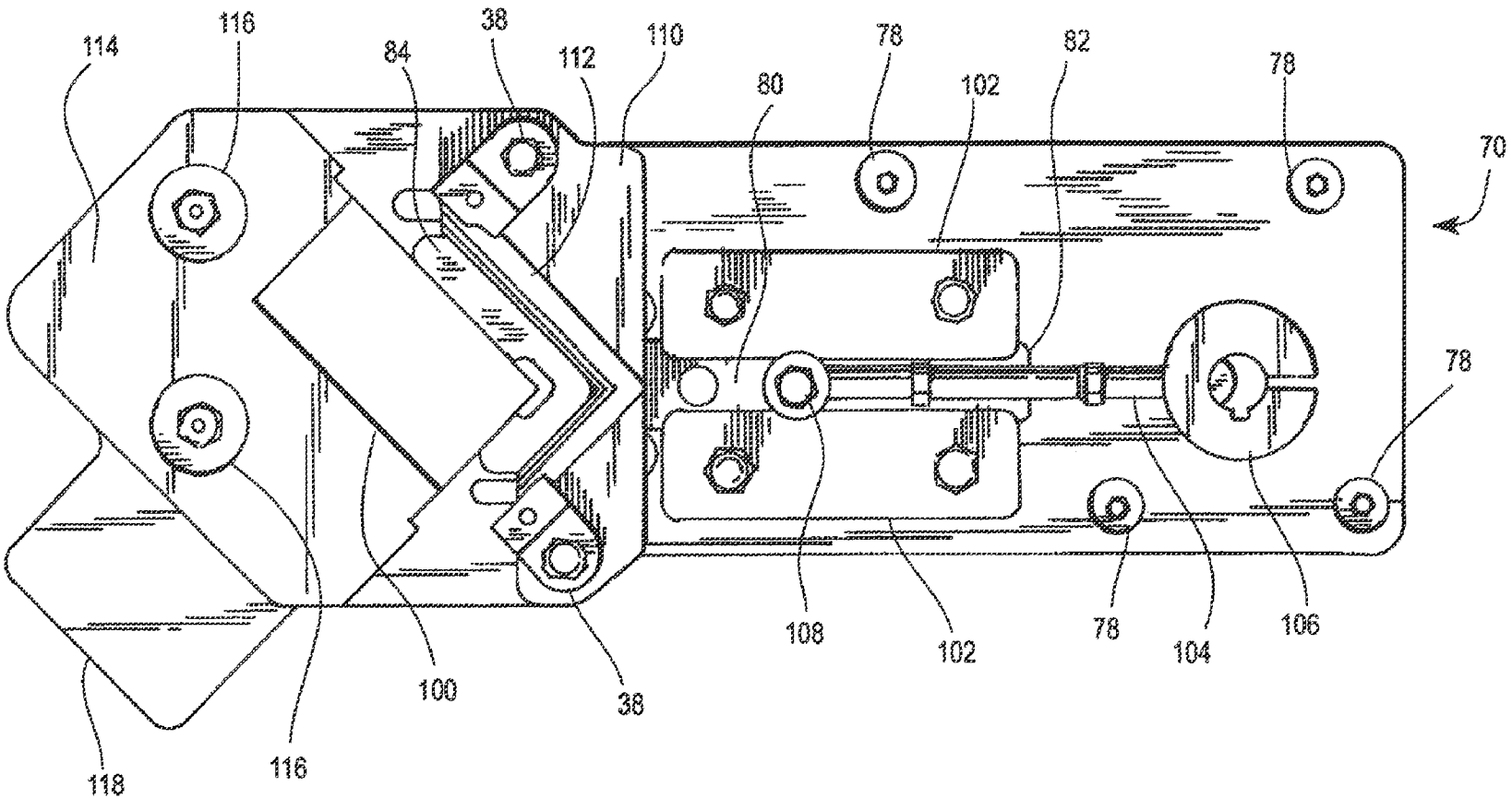
FIG. 5 is a top plan view of the pusher assembly of FIG. 4, showing the reciprocating pusher for moving a cracker toward and the opening in the plate.

The pusher 80 slides on the plate 76 between the positions of maximum advancement and maximum retraction. Toward one end of the plate 76 is the opening 100, which is sized slightly larger than the size of the cracker 12 to permit the cracker 12 to fall therethrough when positioned over the opening 100. A backing plate 114 is attached to the plate 76 and positioned on an opposite side of the opening 100 from the pusher 80, as illustrated in FIGS. 4 and 5. The backing plate 114 has a pair of surfaces that face the opening 100 and provide a stop, if needed, for the advancing cracker 12 to ensure that the cracker 12 is not pushed past the opening 100, but rather falls through the opening 100. Disposed on the opposite side of the opening 100 in the plate 76 from the backing plate 114 are a pair of lateral guides 102, positioned on each side of the shank 82 of the pusher 80. The guides 102 are configured so that they have a portion which at least partially overlaps the top of the shank 82, as shown in FIG. 5, in order to secure the pusher 80 between the plate 76 and the guides 102 so that movement toward or away from the plate 76 is limited. The guides 102 also have a channel in which the shank 82 of the pusher 80 can slide in a direction parallel to the plate 76 and toward or away from the opening 100. Thus, the guides 102 limit the movement of the pusher 80 to linear movement in the retraction or advancement directions, i.e., away from the opening 100 or toward the opening 100, respectively. Further guidance and/or confinement of the movement of the pusher 80 is provided between the guides 102 and the opening 100 by a cover plate 110, which is spaced above the plate 76 on a series of bolts, which can optionally be the same bolts 38 used to secure the feed chute 20 relative to the plate 76, as illustrated in FIG. 3.

The reciprocating movement of the pusher 80, as well as the accelerating and decelerating cycles described in detail above, is accomplished using an eccentric drive. More specifically, the shaft of the motor 72 extends through a center aperture of an eccentric driver 106 to drive the driver 106 for rotation. The motor 72 rests on a plate 74 which is supported above the pusher 82 via posts 78 extending between the lower plate 76 and the motor support plate 74. A link 104 is pivotably connected at one end to the shank 82 of the pusher 80 about a pivot 108 and at an opposite end to a pivot 109 attached to the underside of the driver 106. However, the pivot 109 is spaced from a central axis of rotation the driver 106 extending through the aperture, and thus spaced from the axis of rotation of the shaft of the motor 72 which is received in the aperture of the driver 106. This eccentric drive, in combination with the guides 102, provides for the linear, reciprocating movement of the pusher 80. More specifically, when the driver 106 is rotated to a position where the pivot 109 is closest to the opening 100 in the plate 76, the pusher 80 is at its position of maximum advancement, illustrated in FIGS. 4 and 5. Conversely, when the pivot 109 is rotated to a position where the pivot 109 is furthest from the opening 100, i.e., 180° from the position shown in FIGS. 4 and 5, the pusher is at its position of maximum retraction. Thus, as the driver 106 rotates through 360°, as shown in FIG. 9, the pusher 80 is driven to reciprocate between its positions of maximum advancement and maximum retraction.

Figure 8:
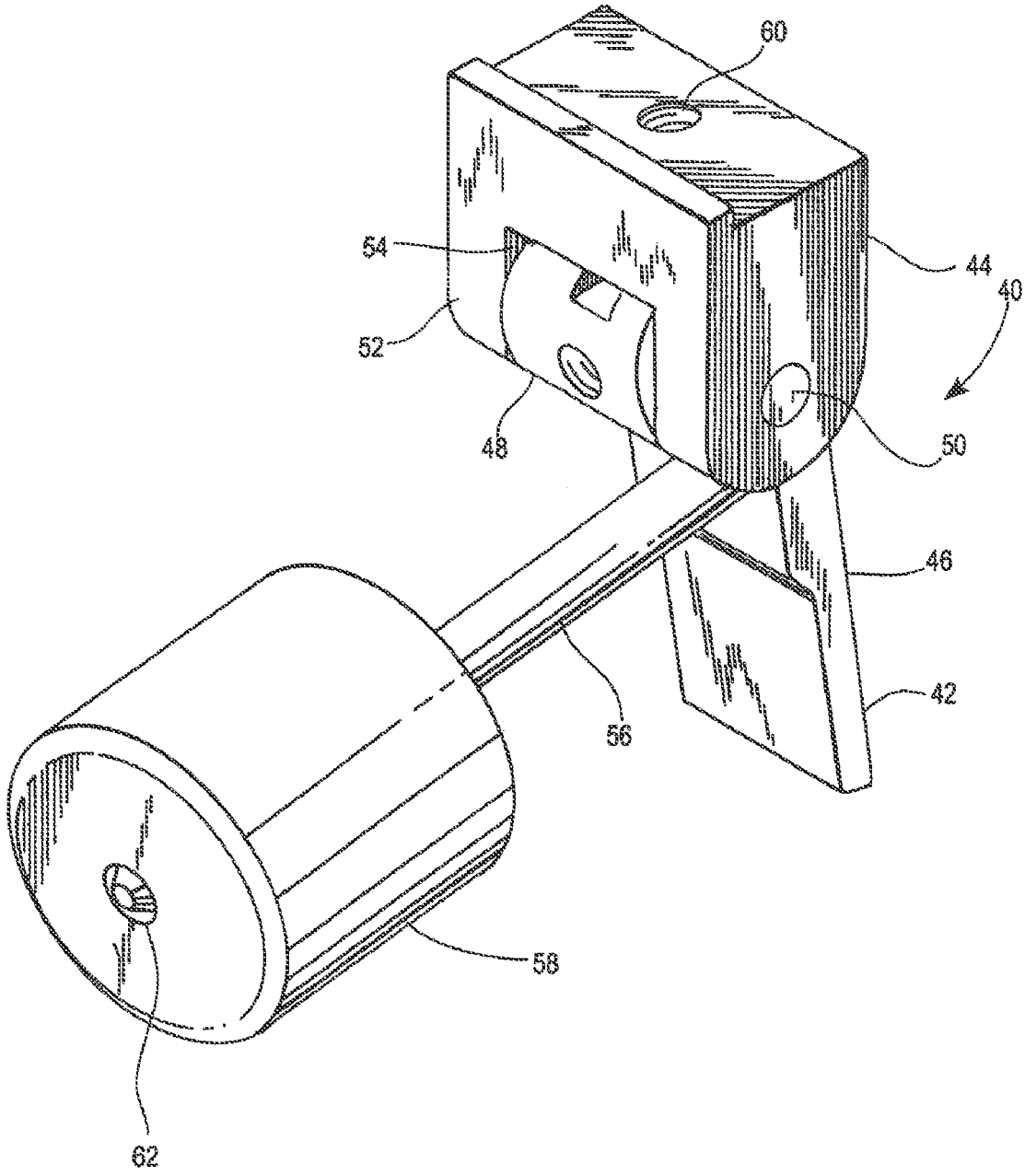
FIG. 8 is a perspective view of a brake of the feed chute of FIG. 3, showing a break weight connected to a brake member, which in turn is pivotably connected to a brake mount for mounting the brake on the feed chute.

Turning to more details of the brake 40, a brake member 42 has a brake weight 58 attached via a brake arm 56, as illustrated in FIG. 8. The brake member 42 has a generally planar portion 46 at one end for abutting and at least partially supporting the stack of food products. At an opposite end, the brake member 42 is pivotably mounted to a brake mount 44, which in turn can be attached to the feed chute 20. Mounting of the brake mount 44 to the feed chute 20 is accomplished by extending a threaded fastener through an aperture in one of the guide rod supports 26 or 28 of the feed chute 20 and into a threaded bore 60 on an upper surface of the brake mount 44. The brake member 42 has a cylindrical portion 48 which is received in a gap 54 between a pair of wings 52 which form a clevis of the brake mount 44. A shaft 50 extends through apertures in the pair of wings 52 of the brake mount 44 and an aperture in the cylindrical portion 48 of the brake member 42 to pivotably connect the brake member 42 to the brake mount 44.

The brake member 42, and specifically the distal tip of the planar portion 46, is urged against the stack of food products by the brake weight 58 so that the planar portion 46 supports at least a portion of the weight of the stack on the distal tip. As the stack moves toward the outlet or bottom of the feed chute 20 one food product thickness at a time, the brake member 42 pivots away from the stack so that the stack can advance. The brake weight 58 then urges the brake member 42 back into supporting engagement with the stack.

One the one hand, the force with which the brake member 42 is urged by the brake weight 58 toward the stack needs to be sufficient to at least partially support the weight of the stack. On the other hand, however, the force with which the brake member 42 is urged against the stack needs to be minimized so that the brake member 42 can overcome the force and pivot out of the way to permit the stack to advance downwardly in the feed chute as each bottommost food product is removed from the stack. In order to achieve this balance, the distance the brake weight 58 from the axis of the shaft 50 can be adjusted to fine tune the force the brake weight 58 applies to urge the brake member 42 toward the stack. In particular, the end of the brake arm 56 to which the brake weight 58 is attached is threaded and is received in a threaded bore 62 of the brake weight 58. In order to increase the force with which the brake member 42 is urged against the stack, the brake weight 58 can be rotated about the brake arm 56 to move it further away from the axis of the shaft 50, thereby increasing the moment arm, which is a function of weight and distance from the pivot axis. Conversely, to decrease the force with which the brake member 42 is urged against the stack, the brake weight 58 can be rotated about the brake arm 56 to move it toward the axis of the shaft 50, thereby increasing the moment arm.

In operation, the crackers 12 are fed to the feed chute 20 of the stacking assembly 10, whereby they are accumulated into a stack of crackers 12 that is confined by the guide rods 22 of the feed cute 20. The bottom of the stack of crackers 12 rests at least partially on the plate 76 of the pusher assembly 80, until the bottommost cracker 12 is slid outwardly from beneath the stack and toward the opening 100 in the plate 76 using the pusher 82 of the pusher assembly 80, as illustrated in FIG. 6. When the cracker 12 is disposed above the opening 100, it can fall into a waiting tray 14 disposed beneath the stacker assembly 10. During the time that the pusher 82 is advancing the bottommost cracker 12 toward the opening 100, the remainder of the stack is supported by the top surface of the pusher 82. Then, after the formerly bottommost cracker 12 has dropped through the opening 100 and into the tray 14, the pusher 82 quickly retracts and the stack can fall to the plate 76, and then the process can repeat and the next cracker 12 in the stack (now the bottommost cracker) can be advanced over the opening 100 and into the tray 14 below. Preferably, though not necessarily, the materials used for construction of the stacker assembly 10 are suitable for exposure to food products, and can include stainless steel. The materials in direct contact with the food products may be configured for reduced friction, such as by polishing.

In view of the foregoing, it will be appreciated that a stacker assembly and method for use is described which can advantageously reduce breakage and marring of food products during stacking or inserting into trays, such as by reducing manipulation of the food products and/or reducing friction between the food product and components of the stacker assembly, while providing for high-speed, commercial filling of the trays with the food products. The drawings and the foregoing descriptions are not intended to represent the only forms of stacker assembly and methods in regard to the details of construction and methods of manufacture. Changes in form and in the proportion of parts, as well as the substitution of equivalents, are contemplated as circumstances may suggest or render expedient; and although specific terms have been employed, they are intended in a generic and descriptive sense only and not for the purposes of limitation.

The invention claimed is:

1. An apparatus for placing at least one thin food product in a container, the apparatus comprising:

a sleeve sized to hold a plurality of food products in a stack, the sleeve having an inlet at an upper end and an outlet at a lower end;

a generally planar plate having an opening, the opening being unaligned with the outlet of the lower end of the sleeve, the sleeve being partially positioned over the opening such that a lowermost food product of the stack is partially positioned over the opening and partially supported by the plate; and a pusher having at least one contact surface positioned to selectively contact the lowermost food product of the stack of a plurality of food products and slide the lowermost food product along the plate and over the opening to permit the lowermost food product to drop through the opening and into a container while supporting at least a portion of the stack of food products in the sleeve.

2. The apparatus of claim 1, wherein the pusher has two spaced contact surfaces for contacting the food product.

3. The apparatus of claim 2, wherein the food product is generally rectangular and the contact surfaces of the pusher are spaced about ninety degrees apart to contact two different sides of the food product.

4. The apparatus of claim 1, wherein the sleeve includes at least one lever arm positioned between the upper and lower ends, the lever arm being pivotable into the sleeve to at least partially support a portion of food products in the sleeve.

5. The apparatus of claim 1, wherein the sleeve has a plurality of lever arms positioned between the upper and lower ends and vertically spaced from each other, the lever arms being pivotable into the sleeve to each at least partially support a portion of food products in the sleeve.

6. The apparatus of claim 5, wherein the sleeve includes a segment having a plurality of spaced apart guides to contain the food products and the lever arms are pivotable relative to the guides.

7. The apparatus of claim 1, wherein the opening of the plate is positioned above a conveyor for sequentially transporting a plurality of trays to positions beneath the opening, the trays having a compartment sized to receive a plurality of food products.

8. The apparatus of claim 7, wherein a cover is provided to block debris from the food products from falling into a secondary compartment of the tray adjacent to the compartment sized to receive a plurality of food products.

9. The apparatus of claim 1, wherein at least one guide is provided to limit movement of the pusher to an advancing direction where the pusher is advanced into contact with the food product and slides the food product along the plate and over the opening and an opposing, retracting direction where the pusher is retracted away from the opening.

10. The apparatus of claim 1, wherein the food product is a generally rectangular food product having an angle of two adjacent intersecting sides and the pusher having at least two contact surfaces orientated approximately perpendicular relative to each other that correspond with the angle of intersecting sides of the food product and wherein the opening is generally rectangular and sized larger than the food product such that the food product can fall through the opening when aligned therewith.

11. The apparatus of claim 1, wherein the food product is generally rectangular and the pusher has two contact surfaces spaced by a portion that does not contact the food product when sliding the lowermost food product along the plate.

12. The apparatus of claim 11, wherein the two contact surfaces of the pusher are orientated to contact different sides of the food product, the contact surfaces each being orientated at an acute angle relative to a direction of advancement of the slider.

13. The apparatus of claim 1, wherein the plate includes a backing plate positioned on an opposite side of the opening from the pusher and having a pair of surfaces that face the opening and provide a stop for the advancing food product.

14. A method of depositing one or more thin food products into a tray, the method comprising:

providing a stack of a plurality of the food products having a bottom one of the plurality of food products partially positioned above the tray while being supported from falling into the tray;

advancing a pusher into contact with the bottom one of the plurality of food products of the stack of food products; and advancing the bottom one of the plurality of food products toward a position above the tray whereby the bottom one of the plurality of food products falls into the tray; and supporting the remainder of the stack on the pusher during the step of advancing the bottom one of the plurality of food products toward the position.

15. An apparatus for placing at least one thin food product in a container, the apparatus comprising:

a sleeve sized to hold a plurality of food products in a stack, the sleeve having an inlet at an upper end and an outlet at a lower end;

a generally planar plate having an opening, the opening being unaligned with the outlet of the lower end of the sleeve; and a pusher having at least one contact surface positioned to selectively contact a lowermost food product of the stack of a plurality of food products and slide the lowermost food product along the plate and over the opening to permit the lowermost food product to drop through the opening and into a container while supporting at least a portion of the stack of food products in the sleeve;

wherein the opening of the plate is positioned above a conveyor for sequentially transporting a plurality of trays to positions beneath the opening, the trays having a compartment sized to receive a plurality of food products;

wherein a cover is provided to block debris from the food products from falling into a secondary compartment of the tray adjacent to the compartment sized to receive a plurality of food products.

* * * * *